US006165959A

United States Patent [19]

Meyer et al.

[11] Patent Number: 6,165,959

[45] Date of Patent: Dec. 26, 2000

[54] NONAQUEOUS DETERGENT COMPOSITIONS CONTAINING BLEACH PRECURSORS

[75] Inventors: Axel Meyer, Brussels; Steven Jozef Louis Coosemans, Kampenhout; Jean-Pol Boutique, Gembloux; James Pyott Johnston, Overijse, all of Belgium

[73] Assignee: The Procter & Gamble Company, Cincinnati, Ohio

[21] Appl. No.: 09/202,879

[22] PCT Filed: Jun. 24, 1997

[86] PCT No.: PCT/US97/10113

§ 371 Date: Dec. 22, 1998

§ 102(e) Date: Dec. 22, 1998

[87] PCT Pub. No.: WO98/00507

PCT Pub. Date: Jan. 8, 1998

Related U.S. Application Data

[60] Provisional application No. 60/020,967, Jun. 28, 1996.

[51] Int. Cl.[7] ..... C11D 1/83; C11D 3/395; C11D 3/20; C11D 7/54

[52] U.S. Cl. ..... 510/311; 510/304; 510/312; 510/313; 510/318; 510/338; 510/340; 510/351; 510/356; 510/361; 510/376; 510/445; 510/446

[58] Field of Search ..... 510/304, 311, 510/312, 313, 318, 338, 340, 351, 356, 361, 376, 445, 446

[56] References Cited

U.S. PATENT DOCUMENTS

| | | | |
|---|---|---|---|
| 4,615,820 | 10/1986 | Hepworth et al. | 252/139 |
| 4,929,380 | 5/1990 | Schulz et al. | 252/121 |
| 5,525,121 | 6/1996 | Heffnet et al. | 8/111 |
| 5,814,592 | 9/1998 | Kahn et al. | 510/304 |

FOREIGN PATENT DOCUMENTS

| | | | |
|---|---|---|---|
| 0 030 096 | 6/1981 | European Pat. Off. | C11D 17/00 |
| 0 565 017 A2 | 4/1993 | European Pat. Off. | C11D 3/39 |
| 0 540 090 A2 | 5/1993 | European Pat. Off. | C11D 17/00 |
| 0 659 876 A2 | 6/1995 | European Pat. Off. | C11D 3/39 |
| 0 738 778 A1 | 10/1996 | European Pat. Off. | C11D 17/00 |
| WO 92/09678 | 6/1992 | WIPO | C11D 17/00 |
| WO 94/03580 | 2/1994 | WIPO | C11D 17/00 |

*Primary Examiner*—Gregory R. Delcotto
*Attorney, Agent, or Firm*—C. Brant Cook; Kim William Zerby; Steven W. Miller

[57] ABSTRACT

A nonaqueous liquid detergent composition comprising a bleach precursor composition comprising: a) a bleach precursor; and b) a surfactant system; and c) an organic acid.

6 Claims, No Drawings

NONAQUEOUS DETERGENT COMPOSITIONS CONTAINING BLEACH PRECURSORS

This application claims the priority of U.S. Provisional Application No. 60/020,967, filed Jun. 8, 1996.

FIELD OF THE INVENTION

This invention relates to nonaqueous laundry detergent products which are in the form of a liquid and which are in the form of stable dispersions of particulate material such as bleaching agents and bleach precursor.

BACKGROUND OF THE INVENTION

Detergent products in the form of liquid are often considered to be more convenient to use than are dry powdered or particulate detergent products. Said detergents have therefore found substantial favor with consumers. Such detergent products are readily measurable, speedily dissolved in the wash water, capable of being easily applied in concentrated solutions or dispersions to soiled areas on garments to be laundered and are non-dusting. They also usually occupy less storage space than granular products. Additionally, such detergents may have incorporated in their formulations materials which could not withstand drying operations without deterioration, which operations are often employed in the manufacture of particulate or granular detergent products.

Although said detergents have a number of advantages over granular detergent products, they also inherently possess several disadvantages. In particular, detergent composition components which may be compatible with each other in granular products may tend to interact or react with each other. Thus such components as enzymes, surfactants, perfumes, brighteners, solvents and especially bleaches and bleach activators can be especially difficult to incorporate into liquid detergent products which have an acceptable degree of chemical stability.

One approach for enhancing the chemical compatibility of detergent composition components in detergent products has been to formulate nonaqueous (or anhydrous) detergent compositions. In such nonaqueous products, at least some of the normally solid detergent composition components tend to remain insoluble in the liquid product and hence are less reactive with each other than if they had been dissolved in the liquid matrix. Nonaqueous liquid detergent compositions, including those which contain reactive materials such as peroxygen bleaching agents, have been disclosed for example, in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

A particular problem that has been observed with the incorporation of bleach precursor in non-aqueous detergents, include the chemical stability of the bleach precursor. EP 339 995 describes a non-aqueous liquid detergent composition comprising a persalt bleach and a precursor therefore, the composition containing a capped alkoxylated nonionic surfactant. EP 540 090 proposes to use a bleach precursor which is relatively insoluble in the non aqueous liquid phase of the liquid detergent composition.

A difficulty associated with the improvement of chemical stability of bleach precursor is that, upon dilution in the wash liquor, the bleach precursors still need to have a certain degree of solubility high enough to be effective as a bleaching species in the wash liquor.

Given the foregoing, there is clearly a continuing need to identify and provide nonaqueous, bleach precursor containing detergent compositions in the form of liquid products that have a high degree of chemical stability in the concentrate along with an efficient bleaching performance in the wash liquor.

Accordingly, it is an object of the present invention to provide a non-aqueous detergent composition wherein the bleach precursors have improved chemical stability in the concentrate, while at the same time still being effective as bleach species in the wash liquor.

According to the present invention, there is provided a nonaqueous detergent composition which is in the form of a liquid, containing a bleaching agent and a bleach precursor composition.

SUMMARY OF THE INVENTION

The present invention provides a nonaqueous heavy-duty detergent composition which is in the form of a liquid, said composition comprising a bleaching agent and a bleach precursor composition.

DETAILED DESCRIPTION OF THE INVENTION

Bleach Precursor Composition

According to the present invention, the bleach precursor composition is in agglomerated or spheronised extrudate form. It has been found that the bleach precursor, when in agglomerated or spheronised extrudate form, has a high degree of chemical stability in the nonaqueous liquid detergent compositions along with efficient bleaching performance in the wash liquor.

According to a preferred embodiment of the present invention, the bleach precursor composition comprises:

a) a bleach precursor; and b) a surfactant system; and c) an organic acid, wherein said surfactant, said precursor and said organic acid are in close physical proximity.

According to another preferred embodiment of the present invention, the bleach precursor composition comprises:

a) a bleach precursor; and b) a surfactant system comprising a non-ethoxylated anionic surfactant and a nonionic surfactant; and c) organic acid, wherein said surfactant, said precursor and said organic acid are in close physical proximity.

For the purpose of the present invention, the term close physical proximity means one of the following:

i) an agglomerate, granule or extrudate in which said precursor, said surfactant system and the organic acid are in intimate admixture;

ii) a bleach precursor particulate coated with one or more layers wherein at least one layer contains one of the surfactant system and/or organic acid component and the other is in intimate admixture with the bleach precursor component;

iii) a surfactant system component coated with one or more layers wherein at least one layer contains the bleach activator in intimate admixture with the other surfactant system component and with the organic acid;

iv) a bleach precursor particulate coated with one or more layers wherein at least one layer contains the surfactant system and/or organic acid.

v) a surfactant system and the organic acid coated with one or more layers wherein at least one layer contains the bleach activator.

It has to be understood by close physical proximity that the precursor, the surfactant system and the organic acid are not three separate discrete particles in the detergent composition.

a) Bleach precursor

An essential component of the invention is a bleach precursor. Bleach precursors for inclusion in the composition in accordance with the invention typically contain one or more N- or O- acyl groups, which precursors can be selected from a wide range of classes. Suitable classes include anhydrides, esters, imides, nitriles and acylated derivatives of imidazoles and oximes, and examples of useful materials within these classes are disclosed in GB-A-1586789.

Suitable esters are disclosed in GB-A-836988, 864798, 1147871, 2143231 and EP-A-0170386. The acylation products of sorbitol, glucose and all saccharides with benzoylating agents and acetylating agents are also suitable. Specific O-acylated precursor compounds include 3,5,5-trimethyl hexanoyl oxybenzene sulfonates, benzoyl oxybenzene sulfonates, cationic derivatives of the benzoyl oxybenzene sulfonates, nonanoyl-6-amino caproyl oxybenzene sulfonates, monobenzoyltetraacetyl glucose and pentaacetyl glucose. Phtalic anhydride is a suitable anhydride type precursor. Useful N-acyl compounds are disclosed in GB-A-855735, 907356 and GB-A-1246338.

Preferred precursor compounds of the imide type include N-benzoyl succinimide, tetrabenzoyl ethylene diamine, N-benzoyl substituted ureas and the N,N-N'N' tetra acetylated alkylene diamines wherein the alkylene group contains from 1 to 6 carbon atoms, particularly those compounds in which the alkylene group contains 1, 2 and 6 carbon atoms. A most preferred precursor compound is N,N-N',N' tetra acetyl ethylene diamine (TAED).

N-acylated precursor compounds of the lactam class are disclosed generally in GB-A-955735. Whilst the broadest aspect of the invention contemplates the use of any lactam useful as a peroxyacid precursor, preferred materials comprise the caprolactams and valerolactams.

Suitable caprolactam bleach precursors are of the formula:

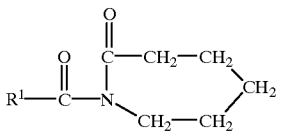

wherein $R^1$ is H or an alkyl, aryl, alkoxyaryl or alkaryl group containing from 1 to 12 carbon atoms, preferably from 6 to 12 carbon atoms.

Suitable valero lactams have the formula:

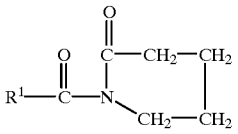

wherein $R^1$ is H or an alkyl, aryl, alkoxyaryl or alkaryl group containing from 1 to 12 carbon atoms, preferably from 6 to 12 carbon atoms. In highly preferred embodiments, $R^1$ is selected from phenyl, heptyl, octyl, nonyl, 2,4,4-trimethylpentyl, decenyl and mixtures thereof.

The most preferred materials are those which are normally solid at <30° C., particularly the phenyl derivatives, ie. benzoyl valerolactam, benzoyl caprolactam and their substituted benzoyl analogues such as chloro, amino, nitro, alkyl, alkyl, aryl and alkyoxy derivatives.

Caprolactam and valerolactam precursor materials wherein the $R^1$ moiety contains at least 6, preferably from 6 to about 12, carbon atoms provide peroxyacids on perhydrolysis of a hydrophobic character which afford nucleophilic and body soil clean-up. Precursor compounds wherein $R^1$ comprises from 1 to 6 carbon atoms provide hydrophilic bleaching species which are particularly efficient for bleaching beverage stains. Mixtures of 'hydrophobic' and 'hydrophilic' caprolactams and valero lactams, typically at weight ratios of 1:5 to 5:1, preferably 1:1, can be used herein for mixed stain removal benefits.

Another preferred class of bleach precursor materials include the cationic bleach activators, derived from the valerolactam and acyl caprolactam compounds, of formula:

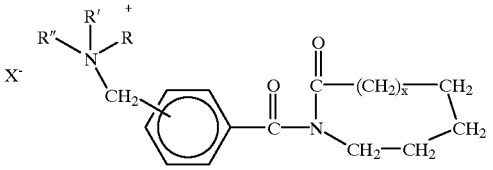

wherein x is 0 or 1, substituents R, R' and R" are each C1–C10 alkyl or C2–C4 hydroxy alkyl groups, or $[(C_yH_{2y})O]_n$—R"' wherein y=2–4, n=1–20 and R"' is a C1–C4 alkyl group or hydrogen and X is an anion.

Suitable imidazoles include N-benzoyl imidazole and N-benzoyl benzimidazole and other useful N-acyl group-containing peroxyacid precursors include N-benzoyl pyrrolidone, dibenzoyl taurine and benzoyl pyroglutamic acid.

Another preferred class of bleach activator compounds are the amide substituted compounds of the following general formulae:

$$R^1N(R^5)C(O)R^2C(O)L \text{ or } R^1C(O)N(R^5)R^2C(O)L$$

wherein $R^1$ is an alkyl, alkylene, aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should preferably not contain more than 18 carbon atoms total. Preferred examples of bleach precursors of the above formulae include amide substituted peroxyacid precursor compounds selected from (6-octanamido-caproyl) oxybenzenesulfonate, (6-nonanamidocaproyl)oxybenzene sulfonate, (6-decanamido-caproyl) oxybenzene-sulfonate, and mixtures thereof as described in EP-A-0170386.

Also suitable are precursor compounds of the benzoxazin-type, as disclosed for example in EP-A-332,294 and EP-A-482,807, particularly those having the formula:

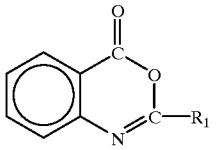

including the substituted benzoxazins of the type

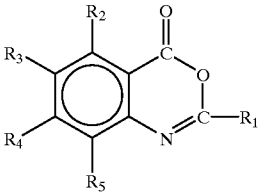

wherein $R_1$ is H, alkyl, alkaryl, aryl, arylalkyl, secondary or tertiary amines and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

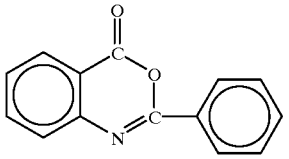

The particles of particulate bleach activator component preferably have a particle size of from 250 micrometers to 2000 micrometers.

These bleach precursors can be partially replaced by preformed peracids such as N,N phthaloylaminoperoxy acid (PAP), nonyl amide of peroxyadipic acid (NAPAA), 1,2 diperoxydodecanedioic acid (DPDA) and trimethyl ammonium propenyl imidoperoxy mellitic acid (TAPIMA).

More preferred among the above described bleach precursors are the amide substituted bleach precursor compounds. Most preferably, the bleach precursors are the amide substituted bleach precursor compounds selected from (6-octanamido-caproyl)oxybenzenesulfonate, (6-nonanamidocaproyl)oxy benzene sulfonate, (6-decanamido-caproyl)oxybenzenesulfonate, and mixtures thereof.

The bleach precursors are normally incorporated at a level of from 20% to 95% preferably 50% to 90% by weight of the bleach activator component and most preferably at least 60% by weight thereof.

b) Surfactant system

Surfactants are useful in the bleaching precursor compositions of the present invention in particular as solubilising agents. Anionic, nonionic, cationic, amphoteric and/or zwitterionic surfactants are useful. Nonlimiting examples of surfactants useful herein include the conventional C11–C18 alkyl benzene sulphonates ("LAS") and primary, branched-chain and random C10–C20 alkyl sulphates ("AS"), the C10–C18 secondary (2,3) alkyl sulphates of the formula $CH_3(CH_2)_x(CHOSO_3^- M^+) CH_3$ and $CH_3(CH_2)_y(CHOSO_3^- M^+)CH_2CH_3$ where x and (y+1) are integers of at least 7, preferably at least about 9, and M is a water-solubilising cation, especially sodium, unsaturated sulphates such as oleyl sulphate, the C10–C18 alkyl alkoxy sulphates ("AEx S"; especially EO 1–7 ethoxy sulphates), C10–C18 alkyl alkoxy carboxylates (especially EO 1–7 ethoxy carboxylates), the C10–C18 glycerol ethers, the C10–C18 alkyl polyglycosides and their corresponding sulphated polyglycosides, the C12–C18 alpha-sulphonated fatty acid esters, methyl ester sulphonate ("MES") and oleoyl sarcosinate.

A preferred embodiment of the present invention is a surfactant system comprising an anionic surfactant and a nonionic surfactant. The surfactant system will typically be present in amount of 0.1% to 50% by weight of the precursor composition, more preferably in an amount of 5–15%.

Preferred anionic surfactants are non-ethoxylated anionic surfactants. These can include salts (including, for example, sodium, potassium, ammonium, and substituted ammonium salts such as mono-, di- and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactants suitable for use herein include the linear and branched primary alkyl sulfates, fatty oleyl glycerol sulfates, the $C_5$–$C_{17}$ acyl-N-($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the group consisting of branched-chain and random C10–C20 alkyl sulphates ("AS"), the C10–C18 secondary (2,3) alkyl sulphates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least 7, preferably at least about 9, and M is a water-solubilising cation, especially sodium, unsaturated sulphates such as oleyl sulphate.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic carboxylate surfactants suitable for use herein include the soaps ('alkyl carboxyls'), especially certain secondary soaps as described herein.

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3$ $CH(R^4)$ COOM, wherein $R^3$ is $CH_3(CH_2)x$ and $R^4$ is $CH_3(CH_2)y$, wherein y can be 0 or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$–$R^6$—COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $CH_3(CHR)_k$—$(CH_2)_m$—$(CHR)_n$—$CH(COOM)(CHR)_o$—$(CH2)_p$—$(CHR)_q$—$CH_3$, wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Other suitable anionic surfactants are the alkali metal sarcosinates of formula R—$CON(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Among the above described non-ethoxylated anionic surfactants, the anionic sulfate surfactants, anionic sulfonate surfactants, or mixtures thereof are preferred. More preferably, the anionic surfactant is selected from salts of $C_{12}$–$C_{15}$ (AS), $C_5$–$C_{20}$ linear alkylbenzene sulfonates and mixtures thereof, and most preferably is the salt of $C_5$–$C_{20}$ linear alkylbenzene sulfonate.

Preferably the anionic surfactant is present in an amount of 1–25%, more preferably 5–15%.

Nonionic Surfactant

Essentially any nonionic surfactants useful for detersive purposes can be included in the compositions such as polyhydroxy fatty acid amide surfactants, condensates of alkyl phenols, ethoxylated alcohol surfactants, ethoxylated/propoxylated fatty alcohol surfactant, ethylene oxide/propylene oxide condensates with propylene glycol, ethylene oxide condensation products with propylene oxide/ethylene diamine adducts, alkylpolysaccharide surfactants, fatty acid amide surfactants and mixtures thereof. Exemplary, non-limiting classes of useful nonionic surfactants are listed below.

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

As ethoxylated/propoxylated fatty alcohol surfactants, the ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3; t is from 0 to 10, preferably 0, and X is from 1.3 to 8, preferably from 1.3 to 3, most preferably from 1.3 to 2.7. The glycosyl is preferably derived from glucose.

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Preferred among the above described nonionic surfactants are the ethoxylated surfactants, preferably selected from ethoxylated alcohol surfactants, ethoxylated/propoxylated fatty alcohol surfactant, ethylene oxide/propylene oxide condensates with propylene glycol, ethylene oxide condensation products with propylene oxide/ethylene diamine adducts and mixtures thereof, more preferably the ethoxylated alcohol surfactants. Most preferred ethoxylated alcohol surfactants are the condensation products of alcohols having an alkyl group containing from 8 to 20 carbon atoms with from 2 to 10 moles of ethylene oxide per mole of alcohol, in particular the linear primary alcohol (C12/C14) condensed with an average of 3 moles of ethylene oxide.

c) Organic Acid

Organic acid compounds suitable for the purposes of the present invention comprise aliphatic or aromatic monomeric or oligomeric carboxylates and preferably comprise monomeric aliphatic carboxylic acids. Examples of such aliphatic acid compounds are glycolic, glutamic, citraconic, succinic, 1-lactic and citric acids. Citric acid is a particularly preferred surface treating agent.

Typical levels of such acids are from 1–30%, preferably from 2–20%, most preferably from 5–15% by weight of the bleach precursor composition. It has been surprisingly found that the organic acid enhances the chemical stability of the bleach precursor in the nonaqueous liquid detergent.

Optionals

Hydrotropes are particularly useful as optional components of the bleach precursor composition in that they surprisingly aid in the solubilisation of the bleach precursor composition. When used, hydrotropes will typically be present in an amount of 0.1–5%, preferably 0.5%–2%. Optional hydrotropes suitable for use herein are selected from the group of lower alkyl aryl sulphonate salts, $C_6$–$C_{12}$ alkanols, $C_1$–$C_6$ carboxylic sulphate or sulphonate salts, urea, $C_1$–$C_4$ hydrocarboxylates, $C_1$–$C_4$ carboxylates and $C_2$–$C_4$ diacids and mixtures thereof.

Suitable lower alkyl aryl sulphonates are preferably $C_7$–$C_9$ alkyl aryl sulphonates and include sodium, potassium, calcium and ammonium xylene sulphonates, sodium, potassium, calcium and ammonium toluene sulphonates, sodium, potassium, calcium and ammonium cumene sulphonate, and sodium, potassium, calcium and ammonium napthalene sulphonates and mixtures thereof.

Suitable $C_1$–$C_8$ carboxylic sulphate or sulphonate salts are any water soluble salts or organic compounds comprising 1 to 8 carbon atoms (exclusive of substituent groups), which are substituted with sulphate or sulphonate and have at least one carboxylic group. The substituted organic compound may be cyclic, acylic or aromatic, i.e. benzene derivatives. Preferred alkyl compounds have from 1 to 4 carbon atoms substiuted with sulphate or sulphonate and have from 1 to 2 carboxylic groups. Examples of suitable hydrotropes include sulphosuccinate salts, sulphophthalic salts, sulphoacetic salts, m-sulphobenzoic acid salts and diesters sulphosuccinates, preferably the sodium or potassium salts as disclosed in U.S. Pat. No. 3,915,903.

Suitable $C_1$–$C_4$ hydrocarboxylates, $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are selected from the salts of cumene sulphonate, xylene sulphonate, toluene sulphonate and mixtures thereof. The salts suitable for use herein are sodium, potassium, calcium and ammonium. Most preferred are sodium cumene sulphonate and calcium xylene sulphonate and mixtures thereof.

Optionally, binding agents may be used in the bleach precursor composition of the present invention. Typical levels of such binding agents are from 1–15%, preferably from 5–10% by weight of the bleach precursor composition. Suitable binding agents include starch, cellulose and cellulose derivatives (e.g. Na—CMC), sugar and film-forming polymers such as polymeric carboxylic acid, including copolymers, polyvinyl pyrrolidone, polyvinyl acetate. Co-polymers of acrylic and maleic acid are particularly preferred.

Form of the Bleach Precursor Composition

The bleach precursor composition may be in any known suitable particulate form for incorporation in a detergent composition, such as agglomerate, granule, extrudate or spheronised extrudate. Preferably, the bleach precursor composition is in a form of a spheronised extrudate.

Preferably, the process for the manufacture of the bleach activator spheronised extrudate comprises the steps of:

(i) preparing a mix of solids, and optionally liquids, comprising the bleach activator;

(ii) extruding the mix through a die under pressure to form an extrudate, the pressure being less 25 bar; and (iii) breaking the extrudate to form the spheronised extrudate.

Preferably, the mixing step (i) is carried out using a a Loedige® FM mixer, the extrusion step (ii) by using a dome extruder such as a Fuji Paudal Model DGL-1, most preferably having a die with 0.8 mm orifices and extruded at a pressure of about 20 bar. Step (iii) is preferably carried using a a rotating disc spheroniser such as a Fuji Paudal QJ-400 where the extrudate are broken down into short lengths and formed into substantially spherical particles.

Preferably, the non-ethoxylated anionic surfactant is mixed in step(i) with the bleach precursor component while the nonionic surfactant is added to the extrudate to form a coating of said extrudate.

The nonaqueous liquid detergent compositions incorporating the peroxy acid bleach precursor particulates will normally contain from 1% to 20% of the precursor particulates, more frequently from 1% to 10% and most preferably from 1% to 7%, on a composition weight basis.

Surprisingly, it has now been found that the bleach precursors of the present invention are physically and chemically stable in the concentrate (the nonaqueous liquid detergent), while at the same time being more effective as a bleach species in the wash liquor.

The nonaqueous detergent compositions of this invention may further comprise a surfactant- and low-polarity solvent-containing liquid phase having dispersed therein the bleach precursor composition. The components of the liquid and solid phases of the detergent compositions herein, as well as composition form, preparation and use, are described in greater detail as follows: All concentrations and ratios are on a weight basis unless otherwise specified.

Surfactant

The amount of the surfactant mixture component of the nonaqueous liquid detergent compositions herein can vary depending upon the nature and amount of other composition components and depending upon the desired rheological properties of the ultimately formed composition. Generally, this surfactant mixture will be used in an amount comprising from about 10% to 90% by weight of the composition. More preferably, the surfactant mixture will comprise from about 15% to 50% by weight of the composition.

A typical listing of anionic, nonionic, ampholytic and zwitterionic classes, and species of these surfactants, is given in U.S. Pat. No. 3,664,961 issued to Norris on May 23, 1972.

Highly anionic preferred surfactants are the linear alkyl benzene sulfonate (LAS) materials. Such surfactants and their preparation are described for example in U.S. Pat. Nos. 2,220,099 and 2,477,383, incorporated herein by reference. Especially preferred are the sodium and potassium linear straight chain alkylbenzene sulfonates in which the average number of carbon atoms in the alkyl group is from about 11 to 14. Sodium $C_{11}$–$C_{14}$, e.g., $C_{12}$, LAS is especially preferred.

Preferred anionic surfactants include the alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{18}$ alkyl component, more preferably a $C_{12}$–$C_{15}$ alkyl or hydroxyalkyl, and M is H or a cation, e.g., an alkali metal cation (e.g. sodium, potassium, lithium), or ammonium or substituted ammonium (quaternary ammonium cations such as tetramethyl-ammonium and dimethyl piperdinium cations).

Highly preferred anionic surfactants include alkyl alkoxylated sulfate surfactants hereof are water soluble salts or acids of the formula $RO(A)_mSO3M$ wherein R is an unsubstituted $C_{10}$–$C_{24}$ alkyl or hydroxyalkyl group having a $C_{10}$–$C_{24}$ alkyl component, preferably a $C_{12}$–$C_{18}$ alkyl or hydroxyalkyl, more preferably $C_{12}$–$C_{15}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include quaternary ammonium cations such as tetramethyl-ammonium and dimethyl piperdinium cations Exemplary surfactants are $C_{12}$–$C_{15}$ alkyl polyethoxylate (1.0) sulfate ($C_{12}$–$C_{15}E(1.0)M$), $C_{12}$–$C_{15}$ alkyl polyethoxylate (2.25) sulfate ($C_{12}$–$C_{15}E(2.25)M$), $C_{12}$–$C_{15}$ alkyl polyethoxylate (3.0) sulfate ($C_{12}$–$C_{15}E(3.0)M$), and $C_{12}$–$C_{15}$ alkyl polyethoxylate (4.0) sulfate ($C_{12}$–$C_{15}E(4.0)M$), wherein M is conveniently selected from sodium and potassium.

Other suitable anionic surfactants to be used are alkyl ester sulfonate surfactants including linear esters of $C_8$–$C_{20}$ carboxylic acids (i.e., fatty acids) which are sulfonated with gaseous $SO_3$ according to "The Journal of the American Oil Chemists Society", 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

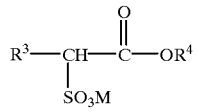

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Other anionic surfactants useful for detersive purposes can also be included in the laundry detergent compositions of the present invention. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary of secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), sulfates of alkylpolysaccharides such as the sulfates of alkylpolyglucoside (the nonionic nonsulfated compounds being described below), and alkyl polyethoxy carboxylates such as those of the formula $RO(CH_2CH_2O)_k$—$CH_2COO$—M+ wherein R is a $C_8$–$C_{22}$ alkyl, k is an integer from 1 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

When included therein, the detergent compositions of the present invention typically comprise from about 1% to about 40%, preferably from about 5% to about 25% by weight of such anionic surfactants.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 14, more preferably from 12 to 14. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements. Especially preferred nonionic surfactants of this type are the $C_9$–$C_{15}$ primary alcohol ethoxylates containing 3–12 moles of ethylene oxide per mole of alcohol, particularly the $C_{12}$–$C_{15}$ primary alcohols containing 5–8 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula

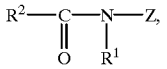

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

Nonaqueous Liquid Diluent

To form the liquid phase of the detergent compositions, the hereinbefore described surfactant (mixture) may be combined with a nonaqueous liquid diluent such as a liquid alcohol alkoxylate material or a nonaqueous, low-polarity organic solvent.

Alcohol Alkoxylates

One component of the liquid diluent suitable to form the compositions herein comprises an alkoxylated fatty alcohol material. Such materials are themselves also nonionic surfactants. Such materials correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol component of the liquid diluent will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful as one of the essential components of the nonaqueous liquid diluent in the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

The alcohol alkoxylate component when utilized as part of the liquid diluent in the nonaqueous compositions herein will generally be present to the extent of from about 1% to 60% by weight of the composition. More preferably, the alcohol alkoxylate component will comprise about 5% to 40% by weight of the compositions herein. Most preferably, the alcohol alkoxylate component will comprise from about 10% to 25% by weight of the detergent compositions herein.

Nonaqueous Low-Polarity Organic Solvent

Another component of the liquid diluent which may form part of the detergent compositions herein comprises nonaqueous, low-polarity organic solvent(s). The term "solvent" is used herein to connote the non-surface active carrier or diluent portion of the liquid phase of the composition. While some of the essential and/or optional components of the compositions herein may actually dissolve in the "solvent"-containing phase, other components will be present as particulate material dispersed within the "solvent"-containing phase. Thus the term "solvent" is not meant to require that the solvent material be capable of actually dissolving all of the detergent composition components added thereto.

The nonaqueous organic materials which are employed as solvents herein are those which are liquids of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol should not be utilized. Suitable types of low-polarity solvents useful in the nonaqueous liquid detergent compositions herein do include alkylene glycol mono lower alkyl ethers, lower molecular weight polyethylene glycols, lower molecular weight methyl esters and amides, and the like.

A preferred type of nonaqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether and dipropylene glycol monobutyl ether are especially preferred. Compounds of the type have been commercially marketed under the tradenames Dowanol, Carbitol, and Cellosolve.

Another preferred type of nonaqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, nonaqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The nonaqueous, low-polarity organic solvent(s) employed should, of course, be compatible and non-reactive with other composition components, e.g., bleach and/or activators, used in the liquid detergent compositions herein. Such a solvent component will generally be utilized in an amount of from about 1% to 60% by weight of the composition. More preferably, the nonaqueous, low-polarity organic solvent will comprise from about 5% to 40% by weight of the composition, most preferably from about 10% to 25% by weight of the composition.

Liquid Diluent Concentration

As with the concentration of the surfactant mixture, the amount of total liquid diluent in the compositions herein will be determined by the type and amounts of other composition components and by the desired composition properties. Generally, the liquid diluent will comprise from about 20% to 95% by weight of the compositions herein. More preferably, the liquid diluent will comprise from about 50% to 70% by weight of the composition.

SOLID PHASE

The nonaqueous detergent compositions herein may further comprise a solid phase of particulate material which is dispersed and suspended within the liquid phase. Generally such particulate material will range in size from about 0.1 to 1500 microns. More preferably such material will range in size from about 5 to 500 microns.

The particulate material utilized herein can comprise one or more types of detergent composition components which in particulate form are substantially insoluble in the nonaqueous liquid phase of the composition. The types of particulate materials which can be utilized are described in detail as follows:

Hydrogen Peroxide Sources

Preferred particulate material which can be suspended are hydrogen peroxide or a source thereof. Preferred sources of hydrogen peroxide include perhydrate bleaches. The perhydrate is typically an inorganic perhydrate bleach, normally in the form of the sodium salt, as the source of alkaline hydrogen peroxide in the wash liquor. This perhydrate is normally incorporated at a level of from 0.1% to 60%, preferably from 3% to 40% by weight, more preferably from 5% to 35% by weight and most preferably from 8% to 30% by weight of the composition.

The perhydrate may be any of the alkalimetal inorganic salts such as perborate monohydrate or tetrahydrate, percarbonate, perphosphate and persilicate salts but is conventionally an alkali metal perborate or percarbonate.

Sodium percarbonate, which is the preferred perhydrate, is an addition compound having a formula corresponding to 2Na2CO3.3H2O2, and is available commercially as a crystalline solid. Most commercially available material includes a low level of a heavy metal sequestrant such as EDTA, 1-hydroxyethylidene 1, 1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. A variety of coatings can be used including borate, boric acid and citrate or sodium silicate of SiO2:Na2O ratio from 1.6:1 to 3.4:1, preferably 2.8:1, applied as an aqueous solution to give a level of from 2% to 10%, (normally from 3% to 5%) of silicate solids by weight of the percarbonate. However the most preferred coating is a mixture of sodium carbonate and sulphate or sodium chloride.

The particle size range of the crystalline percarbonate is from 350 micrometers to 1500 micrometers with a mean of approximately 500–1000 micrometers.

Surfactants

Another type of particulate material which can be suspended in the nonaqueous liquid detergent compositions herein includes ancillary anionic surfactants which are fully or partially insoluble in the nonaqueous liquid phase. The most common type of anionic surfactant with such solubility properties comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{14}$ alkyl, and M is alkali metal. Most preferably R is about $C_{12}$ and M is sodium.

Conventional secondary alkyl sulfates may also be utilized as the essential anionic surfactant component of the solid phase of the compositions herein. Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 or greater and the sum of m+n is typically about 9 to 15, and M is a water-solubilizing cation.

If utilized as all or part of the requisite particulate material, ancillary anionic surfactants such as alkyl sulfates will generally comprise from about 1% to 10% by weight of the composition, more preferably from about 1% to 5% by weight of the composition. Alkyl sulfate used as all or part of the particulate material is prepared and added to the compositions herein separately from the unalkoxylated alkyl sulfate material which may form part of the alkyl ether sulfate surfactant component essentially utilized as part of the liquid phase herein.

Organic Builder Material

Another possible type of particulate material which can be suspended in the nonaqueous liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the requisite particulate material, insoluble organic detergent builders can generally comprise from about 1% to 20% by weight of the compositions herein. More preferably, such builder material can comprise from about 4% to 10% by weight of the composition.

Inorganic Alkalinity Sources

Another possible type of particulate material which can be suspended in the nonaqueous liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the nonaqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the particulate material component, the alkalinity source will generally comprise from about 1% to 15% by weight of the compositions herein. More preferably, the alkalinity source can comprise from about 2% to 10% by weight of the composition. Such materials, while water-soluble, will generally be insoluble in the nonaqueous detergent compositions herein. Thus such materials will generally be dispersed in the nonaqueous liquid phase in the form of discrete particles.

OPTIONAL COMPOSITION COMPONENTS

In addition to the composition liquid and solid phase components as hereinbefore described, the detergent compositions herein can, and preferably will, contain various optional components. Such optional components may be in either liquid or solid form. The optional components may either dissolve in the liquid phase or may be dispersed within the liquid phase in the form of fine particles or droplets. Some of the materials which may optionally be utilized in the compositions herein are described in greater detail as follows:

Optional Inorganic Detergent Builders

The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

Optional Enzymes

The detergent compositions herein may also optionally contain one or more types of detergent enzymes. Such enzymes can include proteases, amylases, cellulases and lipases. Such materials are known in the art and are commercially available. They may be incorporated into the nonaqueous liquid detergent compositions herein in the form of suspensions, "marumes" or "prills". Another suitable type of enzyme comprises those in the form of slurries of enzymes in nonionic surfactants. Enzymes in this form have been commercially marketed, for example, by Novo Nordisk under the tradename "LDP."

Enzymes added to the compositions herein in the form of conventional enzyme prills are especially preferred for use herein. Such prills will generally range in size from about 100 to 1,000 microns, more preferably from about 200 to 800 microns and will be suspended throughout the nonaqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

If employed, enzymes will normally be incorporated into the nonaqueous liquid compositions herein at levels sufficient to provide up to about 10 mg by weight, more typically from about 0.01 mg to about 5 mg, of active enzyme per gram of the composition. Stated otherwise, the nonaqueous liquid detergent compositions herein will typically comprise from about 0.001% to 5%, preferably from about 0.01% to 1% by weight, of a commercial enzyme preparation. Protease enzymes, for example, are usually present in such commercial preparations at levels sufficient to provide from 0.005 to 0.1 Anson units (AU) of activity per gram of composition.

Optional Chelating Agents

The detergent compositions herein may also optionally contain a chelating agent which serves to chelate metal ions, e.g., iron and/or manganese, within the nonaqueous detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylene-diaminetriacetates, nitrilotriacetates, ethylenediamine tetrapropionates, triethylenetetraaminehexacetates, diethylenetriaminepentaacetates, ethylenediaminedisuccinates and ethanoldiglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

Optional Thickening, Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) and polymeric amine derivatives such as quaternized, ethoxylated hexamethylene diamines.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

If utilized, the optional thickening, viscosity control and/or dispersing agents should be present in the compositions herein to the extent of from about 0.1% to 4% by weight. More preferably, such materials can comprise from about 0.5% to 2% by weight of the detergents compositions herein.

Optional Brighteners, Suds Suppressors and/or Perfumes

The detergent compositions herein may also optionally contain conventional brighteners, suds suppressors, silicone oils, bleach catalysts, and/or perfume materials. Such brighteners, suds suppressors, silicone oils, bleach catalysts, and perfumes must, of course, be compatible and non-reactive with the other composition components in a non-aqueous environment. If present, brighteners suds suppressors and/or perfumes will typically comprise from about 0.01% to 2% by weight of the compositions herein.

Suitable bleach catalysts include the manganese based complexes disclosed in U.S. Pat. No. 5,246,621, U.S. Pat. No. 5,244,594, U.S. Pat. No. 5,114,606 and U.S. Pat. No. 5,114,611.

COMPOSITION FORM

The particulate-containing liquid detergent compositions of this invention are substantially nonaqueous (or anhydrous) in character. While very small amounts of water may be incorporated into such compositions as an impurity in the essential or optional components, the amount of water should in no event exceed about 5% by weight of the compositions herein. More preferably, water content of the nonaqueous detergent compositions herein will comprise less than about 1% by weight.

The particulate-containing nonaqueous detergent compositions herein will be in the form of a liquid.

COMPOSITION PREPARATION AND USE

The non-aqueous liquid detergent compositions herein can be prepared by first forming the surfactant-containing non-aqueous liquid phase and by thereafter adding to this phase the additional particulate components in any convenient order and by mixing, e.g., agitating, the resulting component combination to form the phase stable compositions herein. In a typical process for preparing such compositions, essential and certain preferred optional components will be combined in a particular order and under certain conditions.

In a first step of a preferred preparation process, the anionic surfactant-containing powder used to form the surfactant-containing liquid phase is prepared. This pre-preparation step involves the formation of an aqueous slurry containing from 40% to 50% of one or more alkali metal salts of linear $C_{10-16}$ alkyl benzene sulfonic acid and from 3% to 15% of one or more diluent non-surfactant salts. In a subsequent step, this slurry is dried to the extent necessary to form a solid material containing less than 5% by weight of residual water.

After preparation of this solid anionic surfactant-containing material, this material can be combined with one or more of the non-aqueous organic solvents to form the surfactant-containing liquid phase of the detergent compositions herein. This is done by reducing the anionic surfactant-containing material formed in the previously described pre-preparation step to powdered form and by combining such powdered material with an agitated liquid medium comprising one or more of the non-aqueous organic solvents, either surfactant or non-surfactant or both, as hereinbefore described. This combination is carried out under agitation conditions which are sufficient to form a thoroughly mixed dispersion of the LAS/salt material throughout a non-aqueous organic liquid.

In a subsequent processing step, the non-aqueous liquid dispersion so prepared can then be subjected to milling or high shear agitation under conditions which are sufficient to provide the structured, surfactant-containing liquid phase of the detergent compositions herein. Such milling or high shear agitation conditions will generally include maintenance of a temperature between 20° C. and 50° C. Milling and high shear agitation of this combination will generally provide an increase in the yield value of the structured liquid phase to within the range of from 1 Pa to 5 Pa.

After formation of the dispersion of LAS/salt co-dried material in the non-aqueous liquid, either before or after such dispersion is milled or agitated to increase its yield value, the additional particulate material to be used in the detergent compositions herein can be added. Such components which can be added under high shear agitation include any optional surfactant particles, particles of substantially all of an organic builder, e.g., citrate and/or fatty acid, and/or an alkalinity source, e.g., sodium carbonate, can be added while continuing to maintain this admixture of composition components under shear agitation. Agitation of the mixture is continued, and if necessary, can be increased at this point to form a uniform dispersion of insoluble solid phase particulates within the liquid phase.

In a second process step, the bleach precursor particles are mixed with the ground suspension from the first mixing step in a second mixing step. This mixture is then subjected to wet grinding so that the average particle size of the bleach precursor is less than 600 microns, preferably between 50 and 500 microns, most preferred between 100 and 400 microns. Other compounds, such as bleach compounds are then added to the resulting mixture.

After some or all of the foregoing solid materials have been added to this agitated mixture, the particles of the highly preferred peroxygen bleaching agent can be added to the composition, again while the mixture is maintained under shear agitation. By adding the peroxygen bleaching agent material last, or after all or most of the other components, and especially after alkalinity source particles, have been added, desirable stability benefits for the peroxygen bleach can be realized. If enzyme prills are incorporated, they are preferably added to the non-aqueous liquid matrix last.

As a final process step, after addition of all of the particulate material, agitation of the mixture is continued for a period of time sufficient to form compositions having the requisite viscosity, yield value and phase stability characteristics. Frequently this will involve agitation for a period of from about 1 to 30 minutes.

In adding solid components to non-aqueous liquids in accordance with the foregoing procedure, it is advantageous to maintain the free, unbound moisture content of these solid materials below certain limits. Small quantities of free water are typically present in various components of the formulation, e.g. nonionic surfactants and polyethylene glycol, and it is the concentration of water from such sources that should be kept suitably low. Water of crystallisation in materials such as the hydroxycarboxylic acid salt(s), as in sodium citrate dihydrate, is not usually a problem. Free moisture in such solid materials is frequently present at levels of 0.8% or greater. By reducing free moisture content, e.g., by fluid bed drying, of solid particulate materials to a free moisture level of 0.5% or lower prior to their incorporation into the detergent composition matrix, significant stability advantages for the resulting composition can be realized. Preferably, dry and active ingredients (e.g. chelants) are added to keep water level below 0.5% in the liquid matrix. These ingredients can be added as dry materials or be generated in situ by co-drying aqueous solutions of these materials with solutions of surfactants (e.g. LAS).

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 800 to 5,000 ppm of the detergent compositions herein will be provided in aqueous washing/bleaching solution.

The following examples illustrate the preparation and performance advantages of non-aqueous liquid detergent compositions of the instant invention. Such examples, however, are not necessarily meant to limit or otherwise define the scope of the invention herein.

EXAMPLE I

Preparation of the Bleach Precursor Composition

The following bleach precursor particles were made:

| | Example A | Example B | Example C | Example D |
|---|---|---|---|---|
| NACA-OBS | 65 | 65 | — | 65 |
| TAED | — | — | 65 | — |
| LAS | 9.8 | — | 9.8 | 9.8 |
| C12/14 AE3S | — | 9.8 | — | — |
| AE3 | 0.3 | 0.3 | 0.3 | 0.3 |
| STS | 0.96 | 0.96 | 0.96 | 0.96 |
| citric acid | 11.3 | 11.3 | 11.3 | 11.3 |
| Na-CMC | 6.2 | 6.2 | 6.2 | — |
| Water | | to balance to 100% | | |

NACA-OBS: (6-nonanamidocaproyl)oxy benzene sulfonate
TAED: Tetraacetyl ethylene diamine
LAS: Sodium linear C12 alkyl benzene sulphonate
AE3: A $C_{12-15}$ predominantly linear primary alcohol condensed with an average of 3 moles of ethylene oxide
$C_{12}$–$C_{14}$ AE3S: $C_{12}$–$C_{14}$ sodium alkyl sulphate condensed with an average of 3 moles of ethylene oxide per mole
STS: Sodium toluene sulfonate
Na-CMC: Sodium carboxymethyl cellulose In each of examples A to D the bleach activator (i.e. NACA-OBS or TAED) was premixed with citric acid (where present), LAS or AS and an aqueous solution (40% active) of the CMC polymer in a Loedige® FM mixer. The premix was then fed into a dome extruder (Fuji Paudal Model DGL-1) having a die with 0.8 mm orifices and extruded at a pressure of about 20 bar. The resulting extrudate was then fed into a rotating disc spheroniser (Fuji Paudal QJ-400) where they were broken down into short lengths and formed into substantially spherical particles. The particles were then dried in a Niro vibrating fluid-bed dryer resulting in crisp, free-flowing dust free particles with a particle size range of from 0.25 mm to 2.00 mm.

The particles produced in each of the Examples were taken and coated in a drum mixer with 0.4 parts of C12/14AE3 surfactant and then further dusted with 1 part of Zeolite in a second drum mixer.

EXAMPLE II

Preparation of Non-Aqueous Liquid Detergent Composition

1) Butoxy-propoxy-propanol (BPP) and a $C_{12-16}$EO(5) ethoxylated alcohol nonionic surfactant (Genapol 24/50) are mixed for a short time (1–5 minutes) using a blade impeller in a mix tank into a single phase.
2) NaLAS is added to the BPP/Genapol solution in the mix tank to partially dissolve the NaLAS. Mix time is approximately one hour. The tank is blanketed with nitrogen to prevent moisture pickup from the air.
3) If needed, liquid base (LAS/BPP/NI) is pumped out into drums. Molecular sieves (type 3A, 4–8 mesh) are added to each drum at 10% of the net weight of the liquid base. The molecular sieves are mixed into the liquid base using both single blade turbine mixers and drum rolling techniques. The mixing is done under nitrogen blanket to prevent moisture pickup from the air. Total mix time is 2 hours, after which 0.1–0.4% of the moisture in the liquid base is removed. Molecular sieves are removed by passing the liquid base through a 20–30 mesh screen. Liquid base is returned to the mix tank.
4) Additional solid ingredients are prepared for addition to the composition. Such solid ingredients include the following:
   Sodium carbonate (particle size 100 microns)
   Sodium citrate anhydrous
   Maleic-acrylic copolymer (BASF Sokolan)
   Brightener (Tinopal PLC)
   Tetra sodium salt of hydroxyethylidene diphosphonic acid (HEDP)
   Sodium diethylene triamine penta methylene phosphonate These solid materials, which are all millable, are added to the mix tank and mixed with the liquid base until smooth. This approximately 1 hour after addition of the last powder. The tank is blanketed with nitrogen after addition of the powders. No particular order of addition for these powders is critical.
6) The batch is pumped once through a Fryma colloid mill, which is a simple rotor-stator configuration in which a high-speed rotor spins inside a stator which creates a zone of high shear. This partially reduces the particle size of all of the solids. This leads to an increase in yield value (i.e. structure). The batch is then recharged to the mix tank after cooling.
7) The bleach precursor particles are mixed with the ground suspension from the first mixing step in a second mixing step. This mixture is then subjected to wet grinding so that the average particle size of the bleach precursor is less than 600 microns, preferably between 50 and 500 microns, most preferred between 100 and 400 microns.
8) Other solid materials could be added after the first step. These include the following:
   Sodium percarbonate (400–600 microns)
   Protease, cellulase and amylase enzyme prills (400–800 microns)
   Titanium dioxide particles (5 microns)

These non-millable solid materials are then added to the mix tank followed by liquid ingredients (perfume and silicone-based suds suppressor). The batch is then mixed for one hour (under nitrogen blanket). The resulting composition has the formula set forth in Table I.

TABLE I

Non-Aqueous Liquid Detergent Composition with Bleach

| Component | Wt % Active |
|---|---|
| LAS | 21.7 |
| C12-16EO = 5 alcohol ethoxylate | 18.98 |
| BPP | 18.98 |
| Sodium citrate | 1.42 |
| [4-[N-nonanoyl-6-aminohexanoyloxy] benzene sulfonate] Na salt (according to Example I/D) | 7.34 |
| DiEthyleneTriamine-PentaMethylenePhosphate Na salt | 0.90 |
| Chloride salt of methyl quarternized polyethoxylated hexamethylene diamine | 0.95 |
| Sodium Carbonate | 3 |
| Maleic-acrylic copolymer | 3.32 |
| HEDP | 0.90 |
| Protease Prills | 0.40 |
| Amylase Prills | 0.84 |
| Sodium Percarbonate | 18.89 |
| Suds Suppressor | 0.35 |
| Perfume | 0.46 |
| Titanium Dioxide | 0.5 |
| Brightener | 0.14 |
| Miscellaneous up to | 100.00% |

The resulting Table I composition is a stable, anhydrous heavy-duty liquid laundry detergent which provides excellent stain and soil removal performance when used in normal fabric laundering operations.

EXAMPLE III

A bleach-containing nonaqueous laundry detergent is prepared having the composition as set forth in Table II.

TABLE II

| Component | Example 1 Wt. % | Example 2 Wt. % |
|---|---|---|
| Liquid Base | | |
| Sodium Linear alkyl benzene sulfonate | 20 | 20 |
| $C_{12-14}$, EO = 5 alcohol ethoxylate | 20 | 20 |
| N-Butoxy propoxy propanol (BPP) | 20 | 20 |
| Perfume | 1 | 1 |
| Solids | | |
| Trisodium Citrate | 1.5 | 1.5 |
| Sodium percarbonate | 20 | 15 |
| Sodium carbonate | 5 | 10 |
| DiEthylene Triamine Penta Methylene-Phosphate Na salt | 1 | 1 |
| Hydroxyethyl diphosphonate (HEDP) Na salt | 1.5 | 1.5 |
| [4-[N-nonanoyl-6-aminohexanoyloxy] | 5 | 5 |

TABLE II-continued

| Component | Example 1 | Example 2 |
|---|---|---|
| | Wt. % | |
| benzene sulfonate] Na salt average particle size < 500 microns according to Example I/D | | |
| Brightener | 0.2 | 0.2 |
| TiO2 | 0.5 | 0.5 |
| Enzymes and minors | up to 100% | |

The above compositions are stable anhydrous liquid laundry detergents wherein the bleach activator is stable in the concentrate and wherein the bleach activator is effective in the wash liquor.

What is claimed is:

1. A nonaqueous liquid detergent composition comprising a bleach precursor composition comprising:

a)-a bleach precursor wherein said precursor is present in an amount of 10% to 99% by weight of the bleach precursor composition; and b)-a surfactant system comprising a non-ethoxylated anionic surfactant and a nonionic surfactant wherein said surfactant system is present in an amount of 0.1% to 50% by weight of the bleach precursor composition;

c)-an organic acid wherein said organic acid is present in an amount of 1% to 20% by weight of the bleach precursor composition, wherein said bleach precursor composition is in the form of an agglomerate, granule or extrudate which contains said bleach precursor, said surfactant system and said organic acid.

2. A nonaqueous liquid detergent composition according to claim 1, wherein said anionic surfactant is selected from the group consisting sulfate surfactants, sulfonate surfactants, carboxylate surfactants, sarcosinate surfactants and mixtures thereof.

3. A nonaqueous liquid detergent composition according to claim 2, wherein said anionic surfactant is the salt of $C_5$–$C_{20}$ linear alkylbenzene sulfonate.

4. A nonaqueous liquid detergent composition according to claim 1, wherein said nonionic surfactant is selected from the group ethoxylated alcohol surfactants, ethoxylated/propoxylated fatty alcohol surfactant, ethylene oxide/propylene oxide condensates with propylene glycol, ethylene oxide condensation products with propylene oxide/ethylene diamine adducts and mixtures thereof.

5. A nonaqueous liquid detergent composition according to claim 4, wherein said nonionic surfactant is the condensation product of alcohol having an alkyl group containing from 8 to 20 carbon atoms with from 2 to 10 moles of ethylene oxide per mole of alcohol.

6. A nonaqueous liquid detergent composition according to claim 1, wherein said organic acid is citric acid.

* * * * *